US011975936B2

(12) United States Patent
Kodama

(10) Patent No.: US 11,975,936 B2
(45) Date of Patent: May 7, 2024

(54) DISCHARGING APPARATUS

(71) Applicant: SEIKO EPSON CORPORATION, Tokyo (JP)

(72) Inventor: Hidetoshi Kodama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/655,656

(22) Filed: Mar. 21, 2022

(65) Prior Publication Data

US 2022/0306419 A1 Sep. 29, 2022

(30) Foreign Application Priority Data

Mar. 23, 2021 (JP) ..... 2021-048570

(51) Int. Cl.
*B65H 29/70* (2006.01)
*B65H 29/12* (2006.01)

(52) U.S. Cl.
CPC ..... *B65H 29/70* (2013.01); *B65H 29/125* (2013.01); *B65H 2301/5121* (2013.01); *B65H 2404/1115* (2013.01); *B65H 2404/63* (2013.01); *B65H 2801/06* (2013.01)

(58) Field of Classification Search
CPC ..... B65H 29/70; B65H 29/125; B65H 2301/5121; B65H 2404/1115; B65H 2404/63
See application file for complete search history.

(56) References Cited

U.S. PATENT DOCUMENTS

2014/0292978 A1 10/2014 Kodama et al.
2016/0257136 A1 9/2016 Ueno
2018/0170701 A1* 6/2018 Mizuguchi ..... B65H 9/004
2019/0283465 A1* 9/2019 Miyazawa ..... B41J 11/0015

FOREIGN PATENT DOCUMENTS

JP 2014058116 A * 4/2014
JP 2014-196182 A 10/2014
JP 2016-166094 A 9/2016
JP 2020177188 A * 10/2020

* cited by examiner

*Primary Examiner* — Luis A Gonzalez
(74) *Attorney, Agent, or Firm* — WORKMAN NYDEGGER

(57) ABSTRACT

A printer includes a guide frame, a deforming section, and a lever member. The guide frame includes a transport path. The deforming section includes a toothed roller, a supporting holder, and a torsion spring and deforms paper. The toothed roller comes into contact with the paper discharged from the transport path. The supporting holder is configured to pivot between a first position at which the toothed roller is located on the transport path and a second position at which the toothed roller is not located on the transport path. The torsion spring presses the supporting holder from the second position to the first position. The lever member is configured to switch between a regulating state in which pivoting of the supporting holder at the first position or the second position is regulated and a non-regulating state in which pivoting of the supporting holder is not regulated.

15 Claims, 15 Drawing Sheets

DISCHARGING APPARATUS

The present application is based on, and claims priority from JP Application Serial Number 2021-048570, filed Mar. 23, 2021, the disclosure of which is hereby incorporated by reference herein in its entirety.

BACKGROUND

1. Technical Field

The present disclosure relates to a discharging apparatus.

2. Related Art

According to a recording apparatus of JP-A-2014-196182, a holder is attached to a frame in a pivotable manner. The holder holds a toothed roller. A free end of the holder is subjected to an urging force toward a transport surface.

According to a recording apparatus of JP-A-2016-166094, a holder is supported so as to be rotatable with respect to a discharging port. A roller is rotatably supported by a tip end of the holder. When the holder rotates, a position at which paper comes into contact with the roller is displaced in the vertical direction.

According to the configuration of JP-A-2014-196182 or JP-A-2016-166094, since only the roller is supported in a pivotable manner, when a medium is desired to be intentionally shaped, the roller may retreat upon coming into contact with the medium, or when a medium is desired to be suppressed from being shaped, the roller may retreat insufficiently, and it may be difficult to manage a deformation amount of the medium.

SUMMARY

To address the aforementioned problem, a discharging apparatus according to the disclosure includes: an apparatus main body in which a transport path for transporting a sheet is provided; a deforming section that includes a contact section that comes into contact with the sheet discharged from the transport path, a holding section that includes a free end for holding the contact section and a base end held by the apparatus main body and that is configured to pivot between a first position at which the contact section is located on the transport path and a second position at which the contact section is not located on the transport path, and a pressing section that presses the holding section from the second position to the first position, the deforming section enabling the contact section to come into contact with the sheet to deform the sheet; and a regulating section that is configured to switch between a regulating state in which pivoting of the holding section at the first position or the second position is regulated and a non-regulating state in which pivoting of the holding section is not regulated.

DESCRIPTION OF EXEMPLARY EMBODIMENTS

Figure 1:
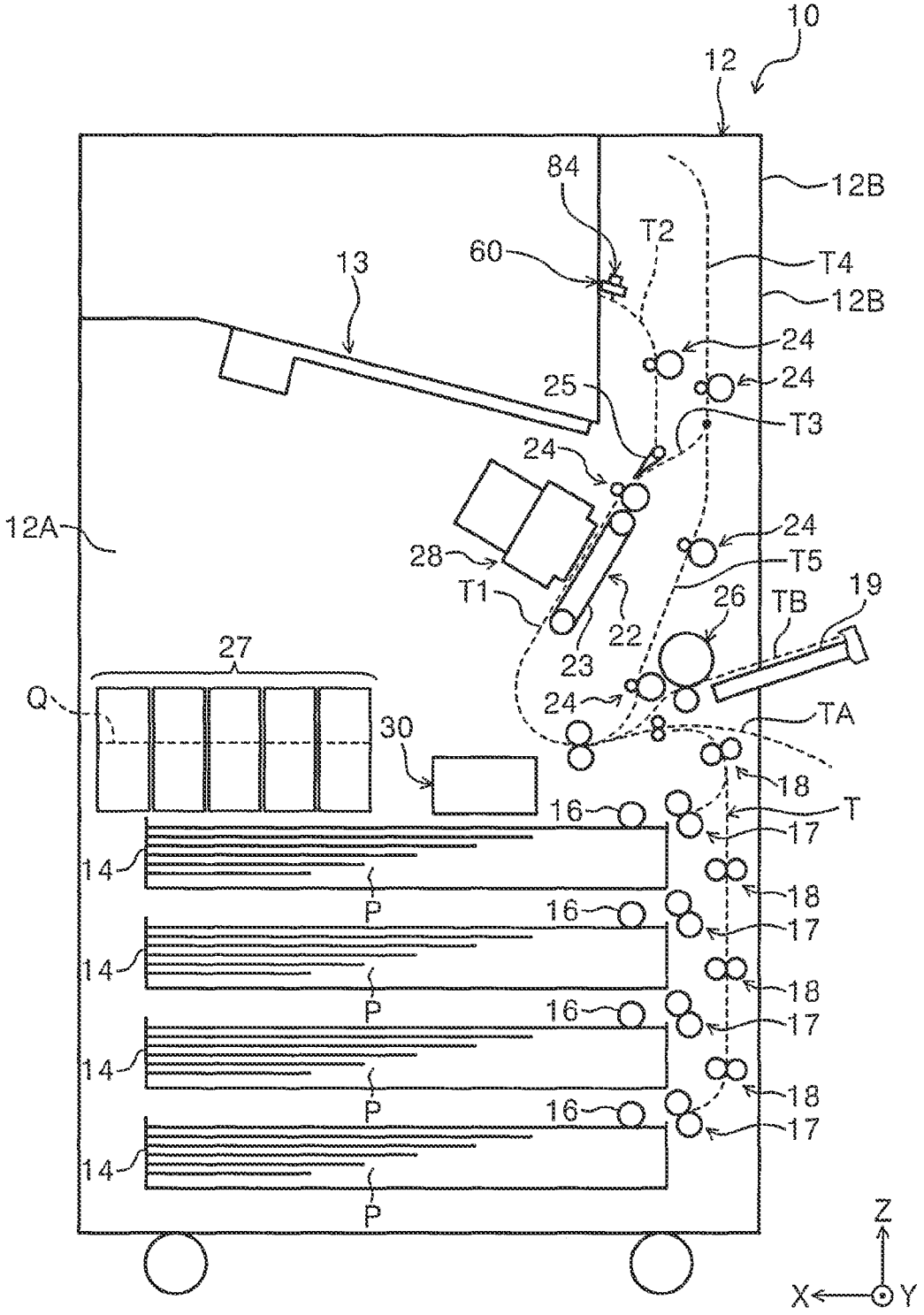
FIG. 1 illustrates an overall configuration of a printer according to an embodiment.

Hereinafter, the disclosure will be schematically described.

A discharging apparatus according to a first aspect includes: an apparatus main body in which a transport path for transporting a sheet is provided; a deforming section that includes a contact section that comes into contact with the sheet discharged from the transport path, a holding section that includes a free end for holding the contact section and a base end held by the apparatus main body and that is configured to pivot between a first position at which the contact section is located on the transport path and a second position at which the contact section is not located on the transport path, and a pressing section that presses the holding section from the second position to the first position, the deforming section enabling the contact section to come into contact with the sheet to deform the sheet; and a regulating section that is configured to switch between a regulating state in which pivoting of the holding section at the first position or the second position is regulated and a non-regulating state in which pivoting of the holding section is not regulated.

According to the present aspect, when the contact section of the deforming section comes into contact with the sheet, the contact section applies a pressing force to the sheet to shape the sheet.

In the non-regulating state, since the holding section of the deforming section is pivotable, the sheet is able to be shaped in accordance with the basis weight of the sheet.

In the regulating state in which the regulating section regulates pivoting of the holding section at the first position, the contact section in contact with the sheet does not retreat from the transport path, and the sheet is thus able to be shaped with a constant amount of deformation.

In the regulating state in which the regulating section regulates pivoting of the holding section at the second position, since neither the holding section nor the contact section is located on the transport path, it is possible to prevent the sheet from being shaped. Further, when the sheet having high stiffness against a force in a thickness direction is used, it is possible to prevent the sheet, which is being discharged, from being subjected to a great load.

In this manner, since a pattern for shaping of the sheet by the deforming section is switched between three patterns in accordance with a type or a state of the sheet, the amount of deformation of the sheet is able to be easily managed.

In the discharging apparatus according to a second aspect, the regulating section of the first aspect is provided to be configured to change a position relative to the deforming section in an intersecting direction that intersects a pivoting direction of the holding section.

According to the present aspect, since the regulating section switches between the regulating state and the non-regulating state by changing its position relative to the deforming section, the regulating section whose position has been changed readily retains the regulating state.

In the discharging apparatus according to a third aspect, the regulating section of the second aspect moves with an axial direction extending along a shaft passing through a pivot center of the holding section as the intersecting direction.

According to the present aspect, a size of the discharging apparatus is able to be reduced in a discharging direction of the sheet compared with a configuration in which the regulating section moves in the discharging direction of the sheet.

The discharging apparatus according to a fourth aspect includes a guiding section that guides the regulating section of the third aspect in the axial direction.

According to the present aspect, since the guiding section guides the regulating section in the axial direction, it is possible to suppress the position of the regulating section from being displaced in a direction intersecting the axial direction.

In the discharging apparatus according to a fifth aspect, the guiding section of the fourth aspect includes a screw including a head section and a shaft section and an edge portion of an elongated hole which extends in the axial direction and into which the shaft section is inserted, and the head section is located downstream in a discharging direction of the sheet with respect to the shaft section.

According to the present aspect, since the regulating section is able to be guided by inserting the screw into the elongated hole to fasten the screw, it is possible to simplify a mechanism of the guiding section. Further, since the head section of the screw is located downstream in the discharging direction of the sheet, the screw is easily accessed from outside of the discharging apparatus.

The discharging apparatus according to a sixth aspect includes an inclined section that extends in a direction intersecting the intersecting direction, in which the inclined section changes a position of the deforming section relative to the regulating section in the pivoting direction by moving the regulating section and the deforming section relative to each other in the intersecting direction, in any of the second to fifth aspects.

According to the present aspect, when the deforming section comes into contact with the inclined section, the deforming section changes its position relative to the regulating section in the pivoting direction. As a result, the deforming section is guided by the inclined section until the deforming section has the regulating state, and the regulating state is thus able to be provided by a simple configuration.

In the discharging apparatus according to a seventh aspect, the holding section of any of the second to sixth aspects includes a flange, the regulating section of any of the second to sixth aspects regulates pivoting of the holding section by regulating movement of the flange, and the flange and the regulating section are disposed in the pivoting direction in an order that is reversed between when the holding section is at the first position and when the holding section is at the second position.

According to the present aspect, by interchanging the flange and the regulating section in the position in the pivoting direction, the regulating state at the first position or the second position is provided, and it is thus possible to simplify a mechanism for providing the regulating state.

In the discharging apparatus according to an eighth aspect, the flange of the seventh aspect comes into contact with the apparatus main body by being subjected to a pressing force from the pressing section when the regulating section has the non-regulating state.

According to the present aspect, when the flange comes into contact with the apparatus main body, pivoting of the holding section of the deforming section is regulated. This makes it possible to suppress the holding section from excessively pivoting.

In the discharging apparatus according to a ninth aspect, the regulating section of the eight aspect is moved to the flange in contact with the apparatus main body to thereby regulate movement of the flange.

According to the present aspect, when the regulating section is moved in a single direction to the flange in contact with the apparatus main body, movement of the flange and pivoting of the holding section are regulated, and pivoting of the holding section is thus able to be readily regulated compared with a configuration in which the regulating section is moved through multiple steps.

In the discharging apparatus according to a tenth aspect, the regulating section of any of the seventh to ninth aspects includes a recess that is configured to accommodate at least a portion of the flange.

According to the present aspect, when at least a portion of the flange is accommodated in the recess, the flange moves less freely, thus making it possible to retain the regulating state.

In the discharging apparatus according to an eleventh aspect, the apparatus main body of any of the first to tenth aspects includes a path member that has a bottom wall which forms a portion of the transport path and a side wall which is provided to stand upright downstream in a discharging direction of the sheet in the bottom wall, and the path member includes an opening which is formed across the bottom wall and the side wall and which enables the deforming section to pass therethrough.

According to the present aspect, since the opening is formed in not only the bottom wall but also the side wall, it is possible to suppress the sheet deformed by the deforming section from being caught by the path member.

In the discharging apparatus according to a twelfth aspect, the regulating section of the eleventh aspect is provided so as to extend from a side of the transport path with respect to the path member toward a side opposite to the side of the transport path through the opening of the side wall.

According to the present aspect, the regulating section that regulates pivoting of the holding section on the side opposite to the transport path side with respect to the path member is able to be operated on the transport path side. Further, when a portion of the opening which is formed in the side wall is at a position away from the transport path, a portion of the regulating section passing through the opening is located at a position away from the transport path, and it is thus possible to suppress a portion of the sheet shaped by the deforming section from being caught by a portion of the regulating section.

In the discharging apparatus according to a thirteenth aspect, the regulating section of the twelfth aspect includes a guiding surface for guiding the sheet downstream in the discharging direction.

According to the present aspect, when the sheet comes into contact with the guiding surface, the sheet is guided downstream in the discharging direction. In this manner, even when the sheet comes into contact with a portion of the regulating section, the sheet is guided downstream in the discharging direction, and it is thus possible to suppress the sheet from being caught by the regulating section.

In the discharging apparatus according to a fourteenth aspect, the apparatus main body of any of the first to thirteenth aspects includes an ejecting section for ejecting a liquid onto the sheet.

According to the present aspect, it is possible to manage the amount of deformation of the sheet onto which the liquid is ejected.

A printer 10, which is an example of a discharging apparatus according to the disclosure, will be specifically described below.

As illustrated in FIG. 1, the printer 10 is configured as an ink jet recording apparatus that performs recording by ejecting ink Q onto paper P. Note that the X-Y-Z coordinate system illustrated in each drawing is an orthogonal coordinate system. The paper P is an example of a sheet. The ink Q is an example of a liquid.

The X direction is an apparatus width direction when viewed from the position of an operator of the printer 10 and is a horizontal direction. In the X direction, a direction toward the left is the +X direction, and a direction toward the right is the −X direction.

The Y direction is a width direction, which intersects a transport direction of the paper P, and is an apparatus depth direction and a horizontal direction. In the Y direction, a direction toward the front is the +Y direction, and a direction toward the rear is the −Y direction.

The Z direction is an example of an apparatus height direction and is the vertical direction. In the Z direction, an upward direction is the +Z direction, and a downward direction is the −Z direction. Note that when no distinction is made between the +X direction and the −X direction, between the +Y direction and the −Y direction, and between the +Z direction and the −Z direction, the +X direction and the −X direction are simply referred to as the X direction, the +Y direction and the −Y direction are simply referred to as the Y direction, and the +Z direction and the −Z direction are simply referred to as the Z direction.

In the printer 10, the paper P is transported on a transport path T indicated by a one-dot-chain line. Note that, since the transport direction in which the paper P is transported extends along the transport path T, the respective portions of the transport path T differ from each other in the transport direction.

The printer 10 includes, for example, a main body section 12, a line head 28, a deforming section 60, and a lever member 84. The printer 10 further includes a manual tray 19, a separation roller pair 26, an ink tank 27, and a control section 30.

The main body section 12 includes a main body frame 12A, guide frames 34 and 36 (FIG. 2) described later, and a housing 12B serving as a housing of the printer 10. The main body section 12 also includes, for example, the line head 28 described later.

A paper discharge tray 13 to which the recorded paper P is discharged is provided on the +Z direction side with respect to the center of the main body section 12 in the Z direction. The main body section 12 includes a plurality of paper cassettes 14 in which the paper P is stored and the transport path T on which the paper P is transported from a paper cassette 14 to the paper discharge tray 13.

A pick roller 16 for separating the paper P, a plurality of transport roller pairs 17 and 18 for transporting the paper P, a transport section 22, a plurality of transport roller pairs 24, a plurality of flaps 25 for switching a path on which the paper P is transported, and the like are disposed on the transport path T. The transport section 22 transports the paper P by circulating a transport belt 23. The transport section 22 faces the line head 28. The transport path T specifically includes a main transport path T1, a discharge path T2, a feeding path T3, a switch-back path T4, and a feeding path T5 and is configured to enable both sides of the paper P to be subjected to recording.

Further, a feeding path TA to which the paper P is fed from an external apparatus (not illustrated) and a manual path TB that extends from the manual tray 19 through the separation roller pair 26 are coupled to the transport path T.

The line head 28 is an example of an ejecting section for ejecting the ink Q, which is supplied from the ink tank 27, onto the paper P. The ink Q is ejected from the line head 28 onto the paper P transported by the transport section 22, and recording is thereby performed on the paper P.

The control section 30 includes a CPU (central processing unit), ROM (read-only memory), RAM (random access memory), and storage, which are not illustrated, and controls transporting and discharging of the paper P in the printer 10 and operations of the respective sections including the line head 28.

Figure 2:
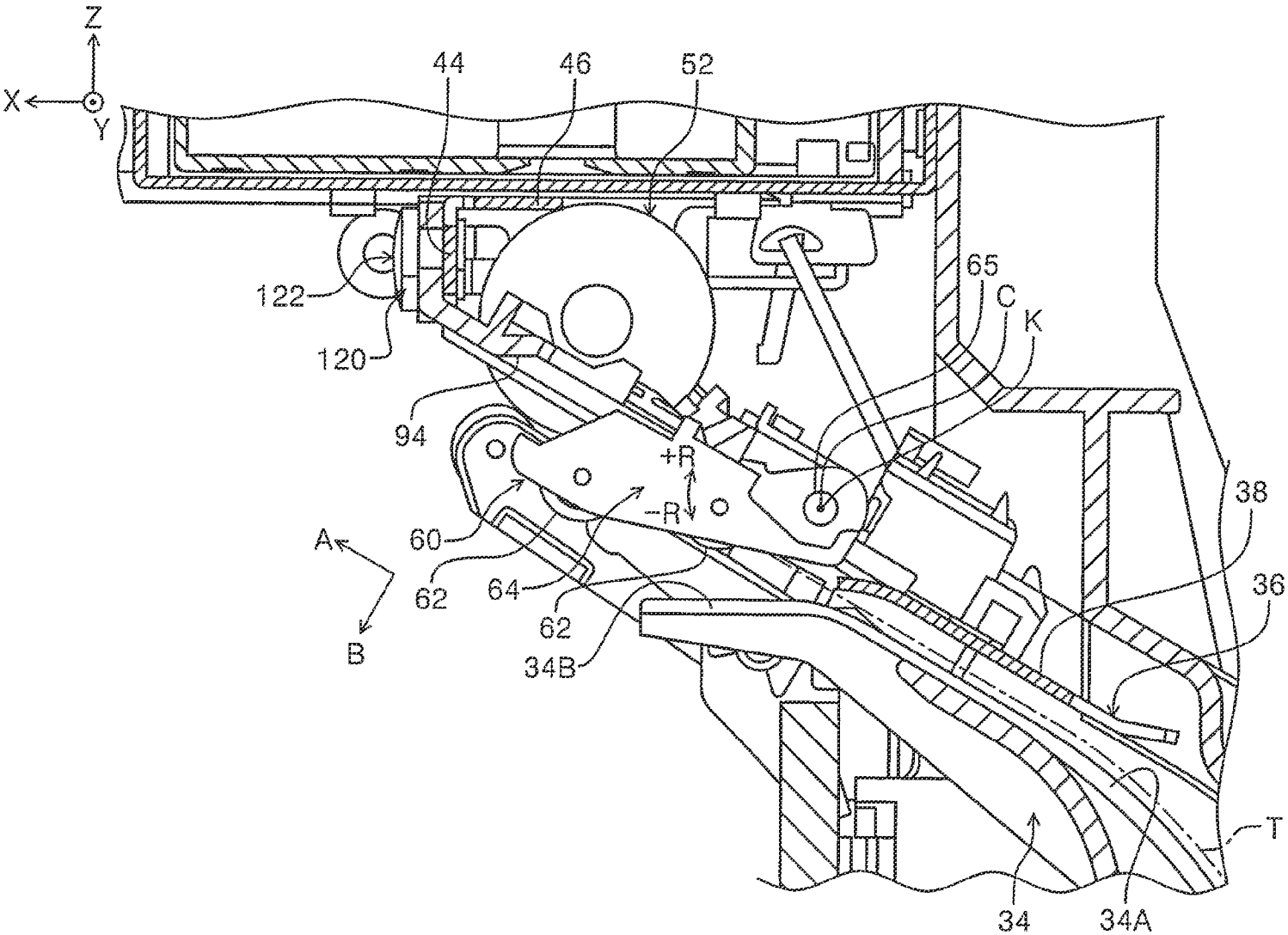
FIG. 2 is a vertical sectional view of the printer according to the embodiment.

As illustrated in FIG. 2, the guide frame 34 and the guide frame 36 are disposed in a downstream end of the transport path T.

The guide frame 34 is located in the −Z direction with respect to the transport path T. The guide frame 34 includes a curved section 34A and a planar section 34B that extends in the +X direction from the +Z direction end of the curved section 34A when viewed in the Y direction. The planar section 34B is located in the +Z direction with respect to the paper discharge tray 13 (FIG. 1).

The guide frame 36 is located to be spaced apart from the guide frame 34 in the +Z direction. The guide frame 36 is an example of an apparatus main body in which the transport path T for transporting the paper P is provided. In other words, the guide frame 36 forms a portion of the transport path T together with the guide frame 34. The guide frame 36 is an example of a path member.

The guide frame 36 includes, for example, a bottom wall 38 that extends obliquely in the +X direction and the +Z direction, a side wall 44 that stands upright in the +Z direction from the bottom wall 38, and an upper wall 46 that extends in the −X direction from the side wall 44.

In the following description, a direction in which the bottom wall 38 extends downstream of the transport path T is direction +A, and a direction that is orthogonal to direction +A and extends toward the paper discharge tray 13 is direction +B. Further, a direction opposite to direction +A is direction −A, and a direction opposite to direction +B is direction −B. When no distinction is made between direction +A and direction −A and between direction +B and direction −B, direction +A and direction −A are simply referred to as direction A, and direction +B and direction −B are simply referred to as direction B.

Figure 3:
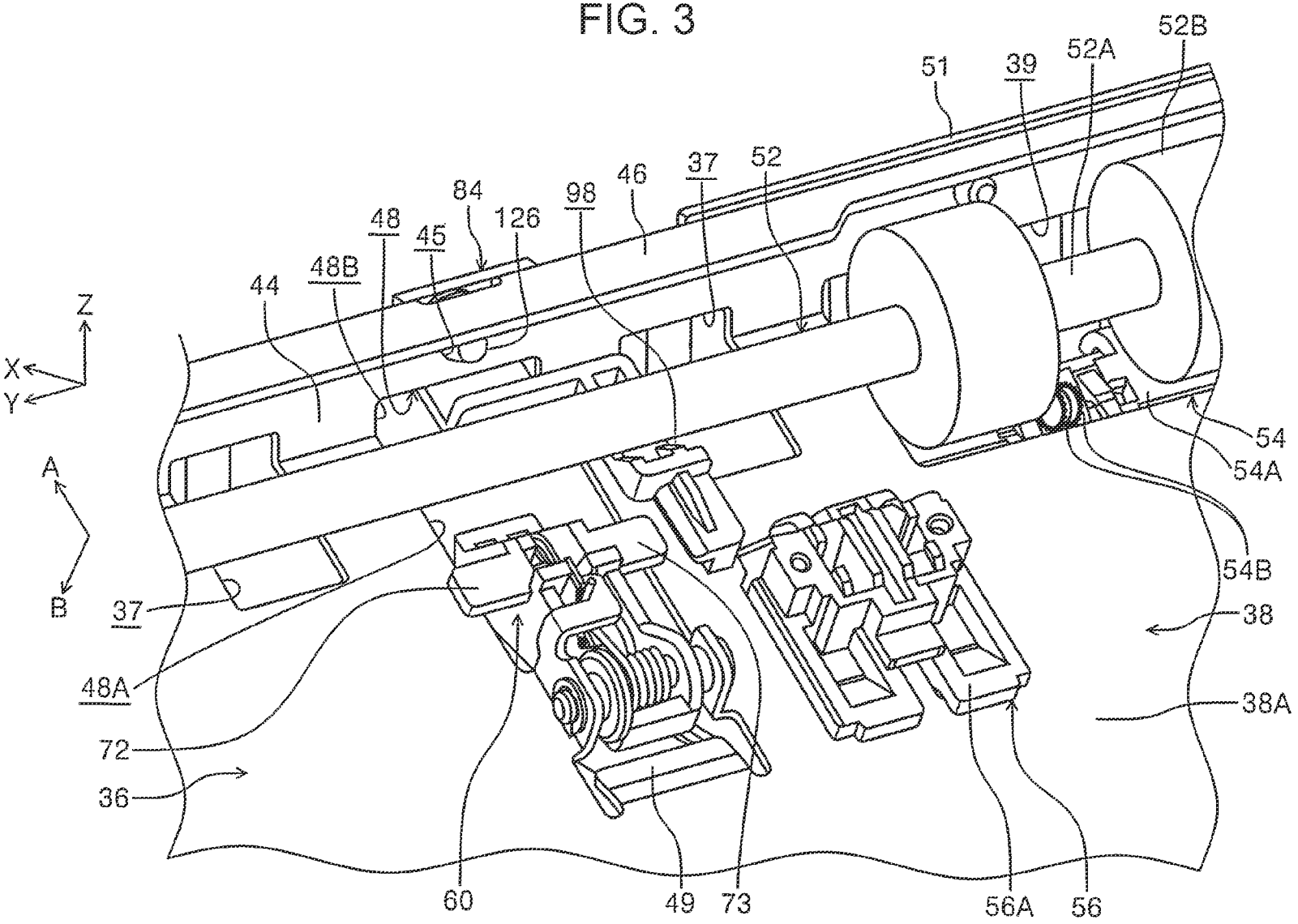
FIG. 3 is a perspective view illustrating an internal structure of the printer according to the embodiment.
Figure 5:
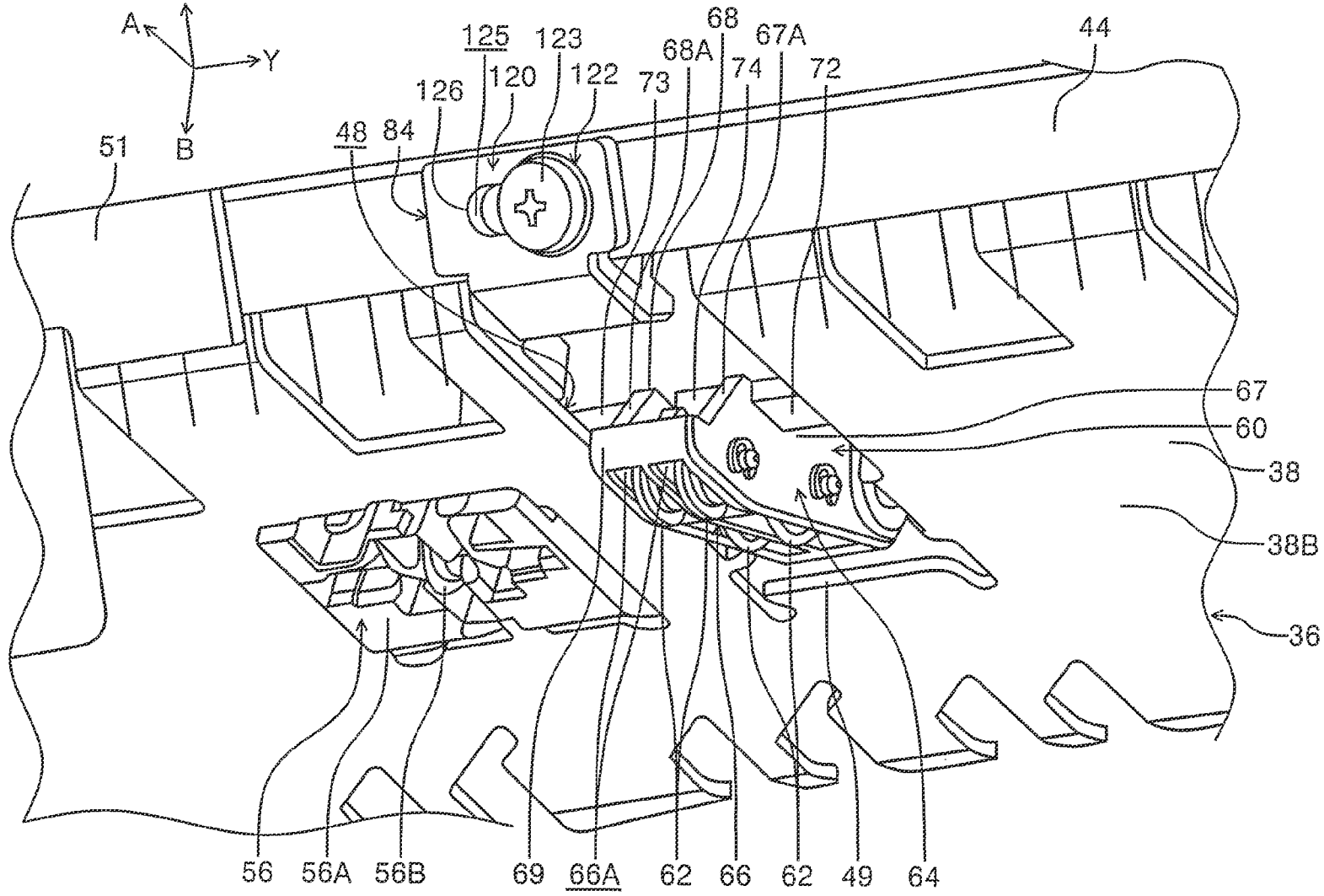
FIG. 5 is a perspective view illustrating a state in which a supporting holder of the printer according to the embodiment is located on a transport path.

As illustrated in FIG. 3, the bottom wall 38 has a planar plate shape that extends in the Y-A plane. The bottom wall 38 forms a portion of the transport path T. In the bottom wall 38, a surface located in the direction −B end is a contact surface 38A, and a surface located in the direction +B end is a paper guiding surface 38B (FIG. 5).

The side wall 44 stands upright in the +Z direction in the direction +A end of the bottom wall 38. In other words, the side wall 44 is provided to stand upright downstream in direction +A, which corresponds to a discharging direction of the paper P, in the bottom wall 38. A fastening hole 45 to which a screw 122 (FIG. 5) described later is fastened is formed in the side wall 44.

The upper wall 46 extends in the −X direction from the +Z direction end of the side wall 44.

Figure 13:
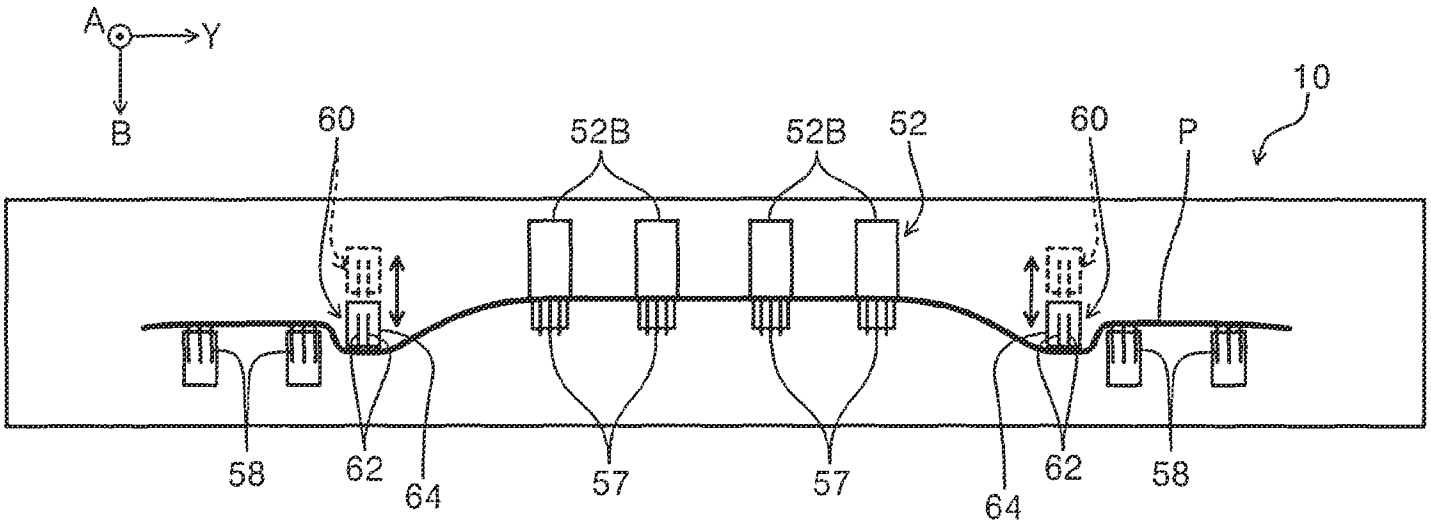
FIG. 13 is a schematic view illustrating a discharge state of paper when the deforming section is able to change its position in accordance with the paper in the printer according to the embodiment.

The guide frame 36 includes, for example, an attachment plate 51, a discharge roller 52, toothed roller units 54 and 56, a driven roller 57, and a supporting roller 58 (FIG. 13).

The attachment plate 51 is attached to the side wall 44 and extends in the −Z direction.

The discharge roller 52 includes a shaft section 52A extending in the Y direction and an annular elastic section 52B attached to a portion of the shaft section 52A.

The toothed roller unit 54 includes a unit main body 54A fixed to the attachment plate 51 and a toothed roller 54B that is supported by the unit main body 54A and rotates about a central axis extending in the Y direction. When the shaft section 52A rotates in a state in which the toothed roller 54B and the elastic section 52B hold the paper P therebetween, the paper P is discharged.

The toothed roller unit 56 includes a unit main body 56A fixed to the bottom wall 38 and a toothed roller 56B (FIG. 5) that is supported by the unit main body 56A and is rotatable about a central axis extending in the Y direction. Note that a toothed roller refers to a roller having a plurality of teeth on an outer circumference.

As illustrated in FIG. 13, the driven roller 57 holds the paper P against the discharge roller 52 and discharges the paper P while rotating in accordance with rotation of the discharge roller 52.

The supporting roller 58 is constituted by, for example, a toothed roller, and a plurality of supporting rollers 58 are provided outside the deforming section 60 described later in the Y direction. The supporting roller 58 supports both ends of the paper P in the Y direction.

As illustrated in FIG. 3, for example, a through hole 37, a through hole 39, and an opening 48 are formed in the guide frame 36. All of the through hole 37, the through hole 39, and the opening 48 are formed across the bottom wall 38 and the side wall 44.

A plurality of through holes 37 are formed with a gap therebetween in the Y direction. The through hole 37 is usable as a working hole or usable for attachment to another unit. The through hole 39 is a hole elongated in the Y direction.

The opening 48 is formed as a single through hole in which a first opening section 48A formed in the bottom wall 38 is coupled to a second opening section 48B formed in the side wall 44. The opening 48 has a size and a shape that enable at least a portion of the deforming section 60 described later to pass through the opening 48.

The first opening section 48A has a rectangular shape having a dimension in direction +A longer than a dimension in the Y direction when viewed in direction +B. The second opening section 48B has a rectangular shape having a dimension in the Y direction longer than a dimension in the Z direction when viewed in the +X direction. An opening area of the first opening section 48A is larger than an opening area of the second opening section 48B. A regulating wall 49 is formed in the direction −A edge portion of the first opening section 48A.

The regulating wall 49 is a wall section that protrudes in the +X direction from the direction −A edge portion of the first opening section 48A. The regulating wall 49 regulates entry of a portion of the paper P, which is being discharged, to the first opening section 48A.

Figure 4:
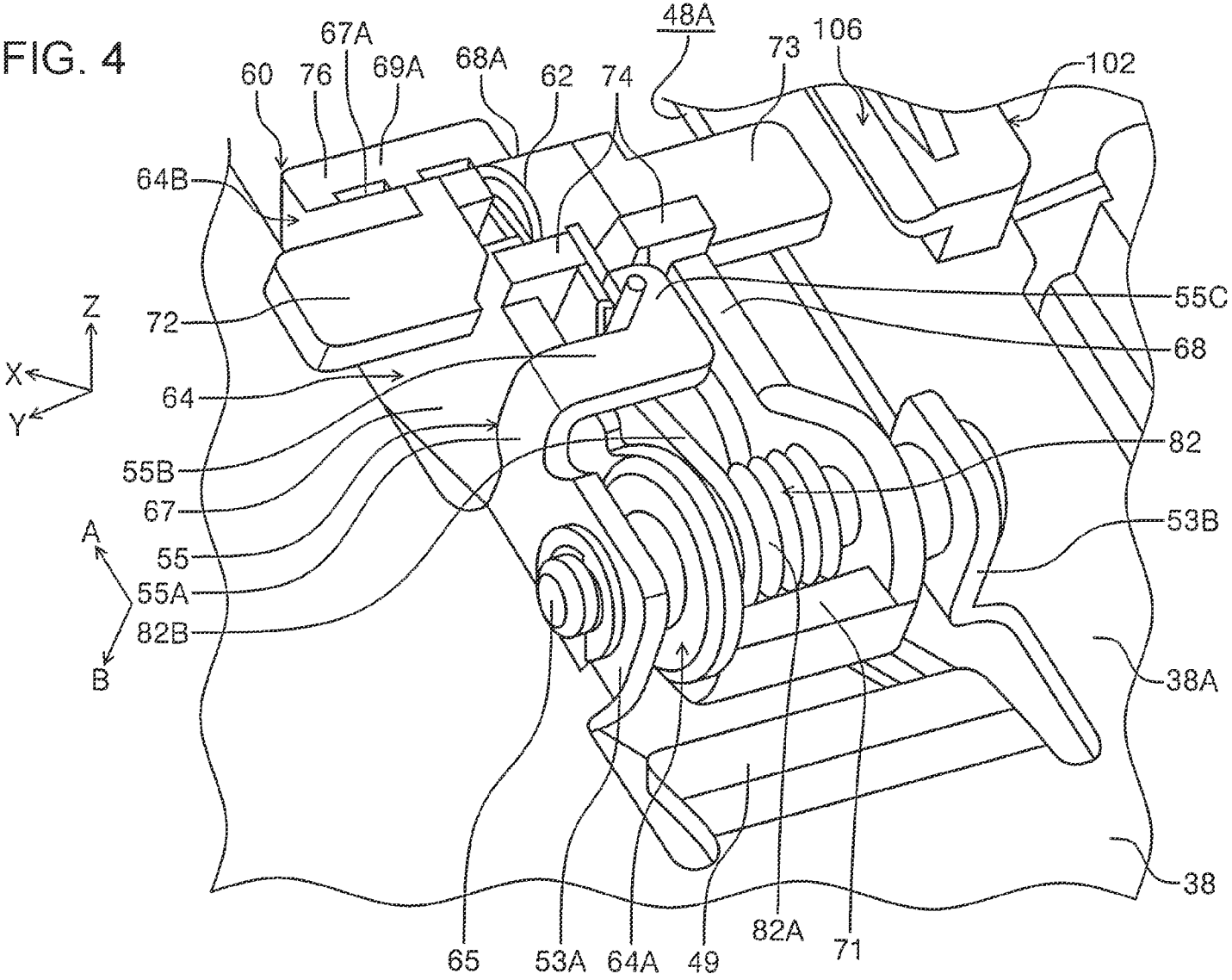
FIG. 4 is a perspective view illustrating a deforming section of the printer according to the embodiment in an enlarged manner.

As illustrated in FIG. 4, a longitudinal wall 53A and a longitudinal wall 53B are provided so as to stand upright in a portion which is further than the regulating wall 49 in direction +A and further than the direction A center of the first opening section 48A in direction −A in an edge portion of the first opening section 48A.

The longitudinal wall 53A stands upright in direction −B in the +Y direction edge portion of the first opening section 48A.

The longitudinal wall 53B stands upright in direction −B in the −Y direction edge portion of the first opening section 48A and faces the longitudinal wall 53A in the Y direction.

A through hole (not illustrated) passes through each of the longitudinal wall 53A and the longitudinal wall 53B in the Y direction. Each of the longitudinal wall 53A and the longitudinal wall 53B rotatably supports a corresponding end of a rotational shaft section 65 described later in the Y direction. A hook section 55 is provided in the direction +A end of the longitudinal wall 53A.

The hook section 55 includes a longitudinal section 55A that stands upright in direction −B, a transverse section 55B that extends in the −Y direction from the direction −B end of the longitudinal section 55A, and an extending section 55C that extends in direction +A from the −Y direction end of the transverse section 55B. An end of a torsion spring 82 described later is placed over an L-shaped portion constituted by the transverse section 55B and the extending section 55C.

The deforming section 60 includes, for example, a plurality of toothed rollers 62, a supporting holder 64, the rotational shaft section 65, and the torsion spring 82.

As the plurality of toothed rollers 62, for example, four toothed rollers 62 are provided in total for a single supporting holder 64; in other words, two toothed rollers 62 are arranged in direction +A and two toothed rollers 62 are arranged in the +Y direction. A toothed roller 62 is an example of a contact section that comes into contact with the paper P, which is discharged from the transport path T (FIG. 2), in direction +B.

As illustrated in FIG. 5, the supporting holder 64 is a member elongated in direction +A and is an example of a holding section that holds the toothed roller 62. The supporting holder 64 is configured as a single member in which, for example, a bottom plate section 66, side plate sections 67 and 68, a front wall 69, a rear wall 71 (FIG. 4), flanges 72 and 73, a rib 74, and an escape section 76 (FIG. 4) are integrally formed.

Arrangement of the respective sections of the supporting holder 64 will be described by assuming that a portion of the supporting holder 64 is disposed on the transport path T.

As illustrated in FIG. 2, the Y direction is an example of a direction intersecting a pivoting direction of the supporting holder 64. Note that, when the supporting holder 64 is viewed from the +Y direction side to the −Y direction side, a direction in which the supporting holder 64 rotates clockwise is direction +R, and a direction in which the supporting holder 64 rotates counterclockwise is direction −R. Direction +R and direction −R are collectively referred to as direction R. Direction R is an example of the pivoting direction.

As illustrated in FIG. 5, the bottom plate section 66 is a planar plate portion that forms the direction +B end of the supporting holder 64. The direction +A end of the bottom plate section 66 is bent obliquely upward so as to intersect direction +A. Two slits 66A are formed in the bottom plate section 66 with a gap therebetween in the Y direction.

The four toothed rollers 62 have outer circumferential portions protruding in direction +B through the two slits 66A. The paper P is able to come into contact with the four toothed rollers 62 but has difficulty in coming into contact with the bottom plate section 66.

The front wall 69 stands upright in direction −B in the direction +A end of the bottom plate section 66. The direction −B end surface of the front wall 69 is an upper surface 69A (FIG. 4).

As illustrated in FIGS. 4 and 5, the side plate section 67 stands upright in direction −B from the +Y direction end of the bottom plate section 66. The side plate section 67 is located in the −Y direction with respect to the longitudinal wall 53A in the first opening section 48A. An inclined surface 67A is formed to be located in direction +A and direction −B with respect to the center of the side plate section 67. The inclined surface 67A is inclined downward in direction +B toward the direction +A side.

When the side plate section 67 is moved in direction −B in accordance with rotation of the supporting holder 64, the direction −B end of the side plate section 67 comes into contact with the transverse section 55B described above, and movement in direction +R is thus regulated. That is, the transverse section 55B functions as a restricting section that restricts rotation of the supporting holder 64.

The side plate section 68 stands upright in direction −B from the −Y direction end of the bottom plate section 66. The side plate section 68 is located in the +Y direction with respect to the longitudinal wall 53B in the first opening section 48A. The side plate section 68 faces the side plate section 67 with a gap therebetween in the Y direction. An inclined surface 68A is formed to be located in direction +A and direction −B with respect to the center of the side plate section 68. The inclined surface 68A is inclined downward in direction +B toward the direction +A side.

The rear wall 71 stands upright in direction −B in the direction −A end of the bottom plate section 66.

As illustrated in FIG. 4, the flange 72 extends in the +Y direction from a portion which is located in direction +A with respect to the center in direction A in the direction −B end of the side plate section 67 and which is located in direction −A with respect to the inclined surface 67A. Specifically, the flange 72 extends up to a position overlapping the edge portion of the first opening section 48A by passing over the first opening section 48A in the +Y direction when viewed in direction +B. The +Y direction end of the flange 72 is located in direction −B with respect to the edge portion of the first opening section 48A. That is, the flange 72 does not protrude to the transport path T through the first opening section 48A.

The flange 73 extends in the −Y direction from a portion which is located in direction +A with respect to the center in direction A in the direction −B end of the side plate section 68 and which is located in direction −A with respect to the inclined surface 68A. Specifically, the flange 73 extends up to a position overlapping the edge portion of the first opening section 48A by passing over the first opening section 48A in the −Y direction when viewed in direction +B. The −Y direction end of the flange 73 is located in direction −B with respect to the edge portion of the first opening section 48A. That is, the flange 73 does not protrude to the transport path T through the first opening section 48A.

The rib 74 stands upright in direction −B from the bottom plate section 66 (FIG. 5) and couples the bottom plate section 66 to the side plate section 67 and to the side plate section 68 separately. The rib 74 functions as a reinforcing section for increasing stiffness against a force applied from outside of the supporting holder 64.

The escape section 76 is a cavity constituted by the upper surface 69A, the inclined surface 67A, and the inclined surface 68A. When the supporting holder 64 is at a first position or a second position described later, the supporting holder 64 does not come into contact with the shaft section 52A (FIG. 3) due to the presence of the escape section 76.

The rotational shaft section 65 has a column shape extending in the Y direction. Each end of the rotational shaft section 65 in the Y direction is rotatably supported by a corresponding one of the longitudinal wall 53A and the longitudinal wall 53B.

In the supporting holder 64, the direction −A end is a base end 64A, and a portion other than the base end 64A is a free end 64B. The base end 64A is attached to the rotational shaft section 65. Thus, the base end 64A is held by the guide frame 36 in a pivotable manner when viewed from the +Y direction side. The free end 64B holds the toothed roller 62 such that the toothed roller 62 is rotatable about an axis extending in the Y direction.

As illustrated in FIG. 2, the supporting holder 64 is held by the guide frame 36 in a pivotable manner. A shaft K passing through a pivot center C of the supporting holder 64 extends in the Y direction. That is, the Y direction is an example of an intersecting direction and an axial direction.

The position of the supporting holder 64 when the plurality of toothed rollers 62 are located on the transport path T is the first position. The position of the supporting holder 64 when the plurality of toothed rollers 62 are not located on the transport path T, that is, when the plurality of toothed rollers 62 have retreated from the transport path T in direction −B, is the second position. The supporting holder 64 is pivotable between the first position and the second position.

As illustrated in FIG. 4, the torsion spring 82 is an example of a pressing section that presses the supporting holder 64 from the second position to the first position. The torsion spring 82 includes a wound section 82A and two arm sections 82B. Note that one of the arm sections 82B is not illustrated.

The wound section 82A is a portion wound in an annular shape. The rotational shaft section 65 is inserted into the wound section 82A. One of the arm sections 82B engages a portion of the supporting holder 64. The other arm section 82B is hooked at the hook section 55.

When the free end 64B of the supporting holder 64 rotates in direction +R (FIG. 2), the torsion spring 82 applies a pressing force to the supporting holder 64 in direction −R. When the torsion spring 82 has a natural state in which the torsion spring 82 is not deformed, the supporting holder 64 is in a state of protruding from the guide frame 36 in direction +B. Here, upon being subjected to the pressing force from the torsion spring 82 when the lever member 84 described later has a non-regulating state, the flange 72 and the flange 73 come into contact with the contact surface 38A of the guide frame 36.

As described above, when the plurality of toothed rollers 62 located on the transport path T come into contact with the paper P in direction +B, the deforming section 60 deforms the paper P into a shape protruding in direction +B. Note that deforming of the paper P by the deforming section 60 is referred to as shaping of the paper P. Shaping of the paper P includes not only shaping of the paper P so as to protrude in direction +B but also shaping of the paper P so as to protrude in another direction.

Figure 6:
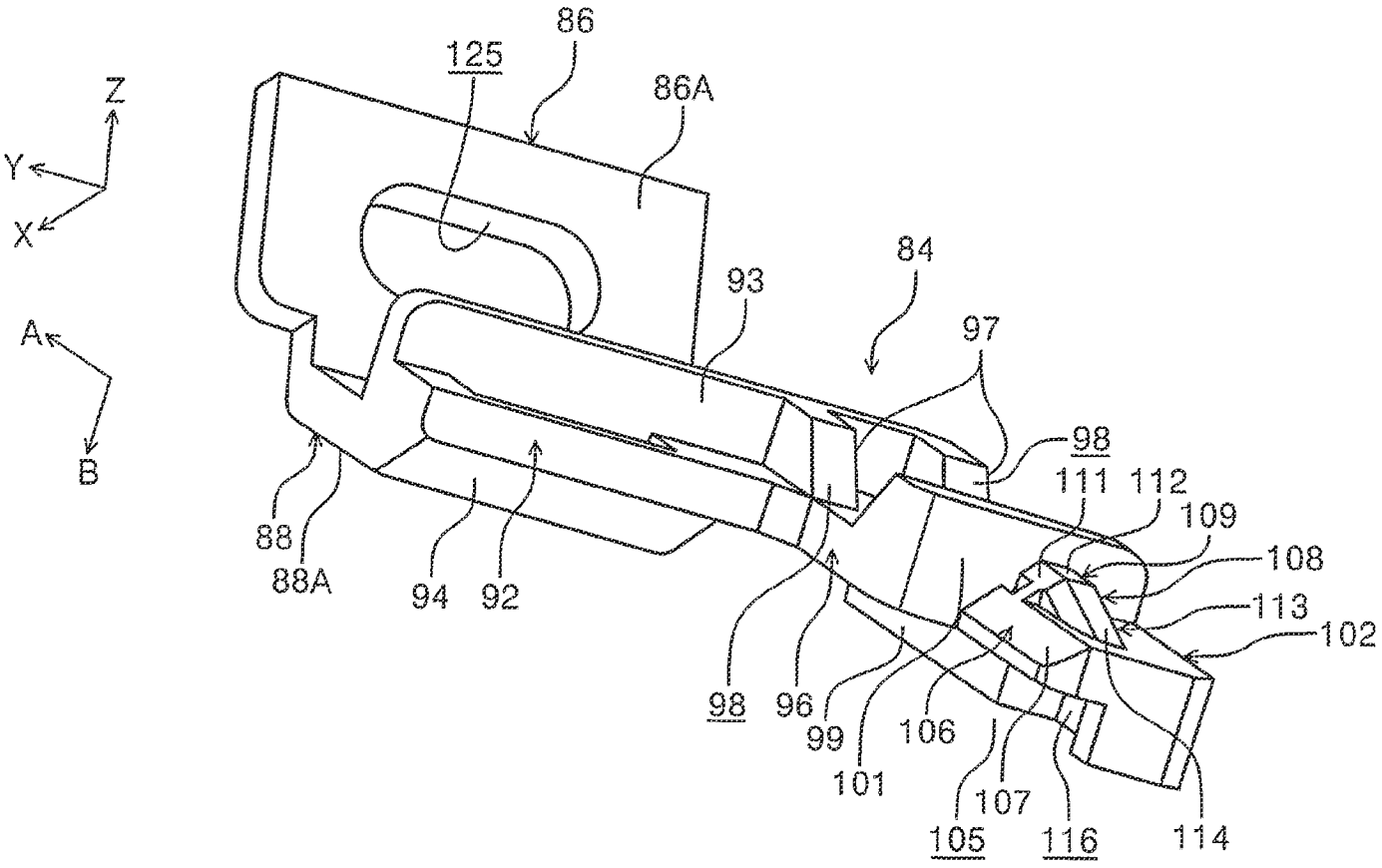
FIG. 6 is a perspective view of a lever member of the printer according to the embodiment.
Figure 7:
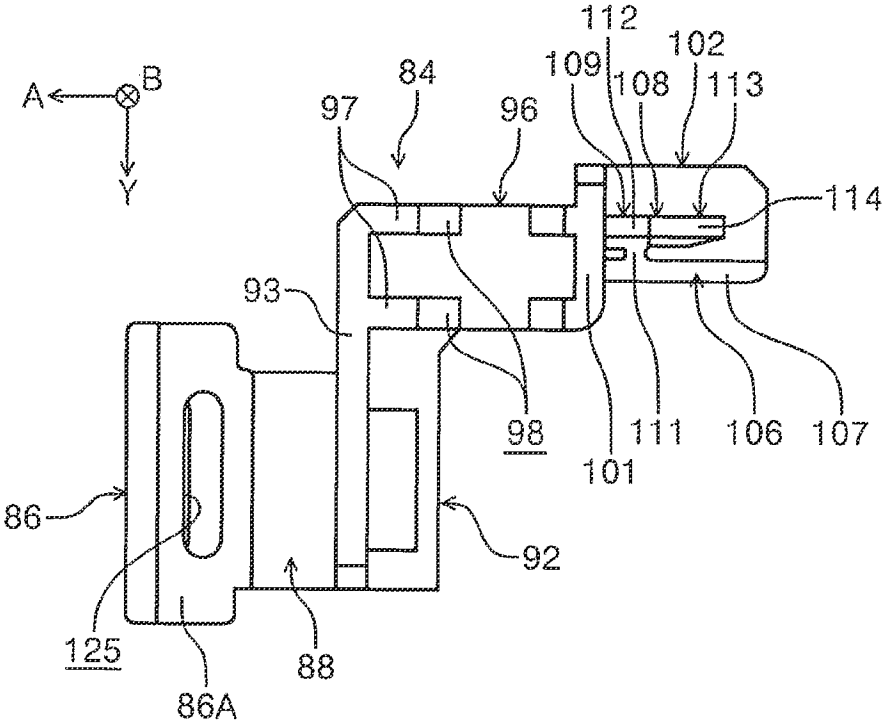
FIG. 7 is a plan view of the lever member of the printer according to the embodiment.
Figure 8:
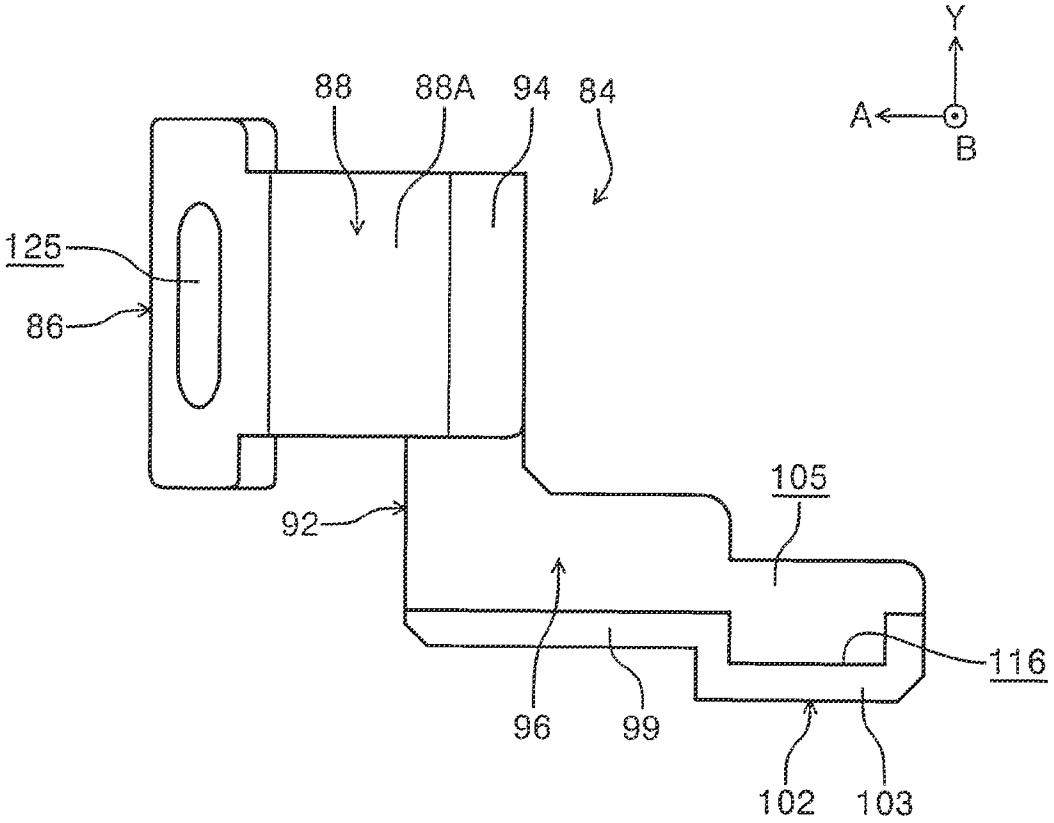
FIG. 8 is a bottom view of the lever member of the printer according to the embodiment.

As illustrated in FIGS. 6 to 8, the lever member 84 is an example of a regulating section capable of switching between a regulating state in which pivoting of the supporting holder 64 at the first position or the second position described above is regulated and the non-regulating state in which pivoting of the supporting holder 64 is not regulated. The lever member 84 is guided in the +Y direction and the −Y direction by a guiding section 120 described later.

The lever member 84 is a member in which, for example, an operation section 86, an insertion section 88, a first extending section 92, a second extending section 96, a third extending section 102, an inclined section 106, a protrusion 108, and a recess 116 are integrally formed. Note that arrangement of the respective sections of the lever member 84 will be described by using directions in a state in which the lever member 84 is attached to the guide frame 36 (FIG. 3) so as to be slidable.

The operation section 86 has a plate shape having a predetermined thickness in the X direction. The operation section 86 has a rectangular shape having a dimension in the Y direction longer than a dimension in the Z direction. The −X direction surface of the operation section 86 is a side surface 86A. An elongated hole 125 that passes through the operation section 86 in the X direction is formed in the center of the operation section 86 in the Y direction and the Z direction. The elongated hole 125 will be described later.

The insertion section 88 extends in direction −A from the −Z direction end of the operation section 86. The insertion section 88 has a plate shape having a predetermined thickness in direction +B. The insertion section 88 width in the Y direction is narrower than the second opening section 48B width in the Y direction (FIG. 3). The insertion section 88 is inserted into the second opening section 48B. In other words, the lever member 84 is provided so as to extend from the transport path T side with respect to the guide frame 36 toward the side opposite to the transport path T through the opening 48 of the side wall 44 (FIG. 3). The direction +B end surface of the insertion section 88 is a bottom surface 88A. Note that the insertion section 88 has, for example, a non-contact state in which the insertion section 88 is not in contact with the guide frame 36.

The first extending section 92 is a planar plate portion that includes the direction −A end of the insertion section 88 and that extends in the −Y direction from the direction −A end of the insertion section 88. The first extending section 92 is disposed to be shifted in direction −B with respect to the insertion section 88. A rib 93 and a guiding surface 94 are formed in the first extending section 92.

The rib 93 has a plate shape that stands upright in direction −B from the first extending section 92 and that has a predetermined thickness in direction +A.

The guiding surface 94 is, for example, an inclined surface that extends in direction +A and direction +B from the direction −A end of the first extending section 92. The guiding surface 94 is coupled to the direction −A end of the bottom surface 88A. The guiding surface 94 guides the paper P downstream in direction +A. The lever member 84 has the guiding surface 94 as described above.

The second extending section 96 is a planar plate portion that extends in direction −A from the −Y direction end of the first extending section 92. Two ribs 97 that are disposed with a gap therebetween in the Y direction and stand upright in direction −B are formed in the direction −B end of the second extending section 96. A cavity 98 that is open in direction −B is formed in each of the two ribs 97. Due to the presence of the cavity 98, the shaft section 52A (FIG. 3) does not come into contact with the lever member 84.

A leg section 99 that protrudes in direction +B is formed in a portion corresponding to the direction +B end and the −Y direction end of the second extending section 96. The leg section 99 supports the second extending section 96. A longitudinal wall 101 that couples the two ribs 97 in the Y direction is formed in the direction −A end of the second extending section 96.

The third extending section 102 is a plate portion that extends in direction −A from the longitudinal wall 101. A leg section 103 that protrudes in direction +B is formed in the third extending section 102. The leg section 103 is formed to be integrated with the leg section 99 and supports the third extending section 102.

A space 105 is formed in direction +B with respect to the second extending section 96 and the third extending section 102 and in the +Y direction with respect to the leg section 99 and the leg section 103.

A dimension corresponding to the space 105 height in direction −B is longer than a dimension corresponding to the flange 73 thickness in direction −B (FIG. 4). That is, the −Y direction end of the flange 73 is able to enter the space 105.

The inclined section 106 is formed in, for example, the +Y direction end of the third extending section 102. The inclined section 106 extends in a direction intersecting the Y direction. Specifically, the inclined section 106 has an inclined surface 107.

The inclined surface 107 is inclined from the −Y direction side to the +Y direction side such that the +Y direction end is located in the −Z direction with respect to the −Y direction end. An angle formed by the inclined surface 107 with respect to the Y direction when viewed in direction +A is, for example, 45°.

The inclined section 106 changes the position of the deforming section 60 (FIG. 3) relative to the lever member 84 in direction R by moving the lever member 84 and the deforming section 60 relative to each other in the Y direction.

The protrusion 108 is located in the −Y direction with respect to the inclined section 106 in the third extending section 102. The protrusion 108 protrudes in direction −B from the third extending section 102. The protrusion 108 includes, for example, a first protrusion 109 and a second protrusion 113 located in direction −A with respect to the first protrusion 109. The first protrusion 109 and the second protrusion 113 are integrally formed.

The first protrusion 109 includes an auxiliary inclined surface 111 and a riding surface 112.

The auxiliary inclined surface 111 is inclined at substantially the same angle as the inclined surface 107 and is continuous to a portion of the inclined surface 107. The auxiliary inclined surface 111 extends up to the riding surface 112.

The riding surface 112 is, for example, a planar surface extending in the Y-A plane. The riding surface 112 extends in the −Y direction from the −Y direction end of the auxiliary inclined surface 111.

The second protrusion 113 has a support surface 114. The support surface 114 is a surface that is inclined obliquely downward such that the height in direction −B decreases from the direction −A end of the riding surface 112 to the direction −A side. An angle formed by the support surface 114 with respect to direction +A when viewed in the −Y direction is, for example, substantially 30°.

As illustrated in FIG. 8, the recess 116 is, for example, a portion that is formed in the leg section 103 and that is open in the +Y direction. An interior of the recess 116 is in communication with the space 105. The recess 116 has a U-shape when viewed in direction −B. The recess 116 width in the Y direction is wider than the flange 73 width in the Y direction (FIG. 3). As described above, the lever member 84 includes the recess 116 in which the −Y direction end of the flange 73 is able to be accommodated.

When the −Y direction end of the flange 73 is located on the bottom wall 38 (FIG. 3) and is accommodated in the recess 116, movement of the flange 73 in direction R and direction A is regulated. Note that movement of the flange 73 in the Y direction has already been regulated.

As illustrated in FIG. 5, the guiding section 120 guides the lever member 84 in the Y direction. The guiding section 120 includes, for example, a screw 122 and an edge portion 126 of the elongated hole 125.

The screw 122 includes a head section 123 and a column-like shaft section 124 (FIG. 3) that extends in the −X direction from the head section 123. An external thread section (not illustrated) is formed on an outer circumferential surface of the shaft section 124. The shaft section 124 is fastened to the fastening hole 45 (FIG. 3).

The head section 123 is located downstream in direction +A with respect to the shaft section 124.

The elongated hole 125 extends in the Y direction. The elongated hole 125 dimension in the Y direction is longer than a dimension corresponding to an amount of movement in the Y direction required for the lever member 84. Thus, the lever member 84 is able to reach a regulating position at which pivoting of the supporting holder 64 is regulated. The lever member 84 is also able to move to a retreat position away from the regulating position. The elongated hole 125 has a size that enables the shaft section 124 to be inserted in the X direction.

Here, when the edge portion 126 comes into contact with the shaft section 124, which is fastened to the side wall 44, in the Z direction, movement of the lever member 84 in the Z direction is regulated. Further, when the lever member 84 is held between the head section 123 and the side wall 44 in the X direction, movement of the lever member 84 in the X direction is regulated. Accordingly, the lever member 84 is movable in the Y direction.

As described above, the lever member 84 is provided so as to be able to change its position relative to the deforming section 60 in the Y direction intersecting direction R of the supporting holder 64.

The lever member 84 regulates pivoting of the supporting holder 64 by regulating movement of the flanges 72 and 73 (FIG. 4). The flanges 72 and 73 and the lever member 84 are disposed in direction R in an order that is reversed between when the supporting holder 64 is at the first position and when the supporting holder 64 is at the second position.

Further, the lever member 84 moves to the flange 73 in contact with the guide frame 36 to thereby regulate movement of the flange 73.

Next, operation of the printer 10 will be described.

A first pattern, a second pattern, and a third pattern will be described as patterns for whether or not pivoting of the deforming section 60 is regulated by the lever member 84. Note that reference to figures in which the respective members are illustrated will be omitted in some cases.

In the first pattern, the paper P is shaped in accordance with stiffness against a force acting in the transport direction of the paper P. In other words, the first pattern is a pattern in which the supporting holder 64 is pivotable. The first pattern is used, for example, when stiffness of the paper P having relatively low stiffness is increased or when a load on the deforming section 60 during discharging of the paper P having relatively high stiffness is reduced.

In the second pattern, the paper P is intentionally shaped. In other words, the second pattern is a pattern in which the supporting holder 64 is temporarily fixed at the first position in a state in which the supporting holder 64 protrudes to the transport path T. The second pattern is used, for example, when the paper P having relatively high stiffness is used and is intentionally shaped to improve stackability of a plurality of sheets of paper P in the paper discharge tray 13. In addition, when the recording density is high, stiffness of the paper P may be reduced due to an increase in the amount of the ink Q that adheres to and permeates the paper P. Also in such an instance, the paper P may be intentionally shaped.

In the third pattern, shaping of the paper P is not allowed. In other words, the third pattern is a pattern in which the supporting holder 64 is temporarily fixed at the second position in a state in which the supporting holder 64 is retreated from the transport path T. The third pattern is used, for example, when shaping of the paper P has an influence on processing to be performed for the paper P by another processing apparatus after the paper P is discharged.

As illustrated in FIGS. 2 to 5, in the first pattern, the screw 122 in the fastened state is loosened to move the lever member 84 in the −Y direction. Thus, pivoting of the deforming section 60 is not regulated by the lever member 84. Note that, when the supporting holder 64 rotates in direction −R, the flanges 72 and 73 come into contact with the bottom wall 38, and the deforming section 60 is restricted from excessively protruding to the transport path T. Moreover, when the supporting holder 64 rotates in direction +R, the supporting holder 64 comes into contact with the transverse section 55B, and the deforming section 60 is thus restricted from excessively entering the guide frame 36.

As illustrated in FIG. 13, in the first pattern, when the paper P having low stiffness is discharged, the supporting holder 64 is pressed in direction +B by the torsion spring 82 (FIG. 4), and the plurality of toothed rollers 62 thus come into contact with the paper P, such that a portion of the paper P in the Y direction is shaped. As a result, since the stiffness of the paper P against a force acting in direction −A is increased, the discharged paper P is less likely to be bent in direction +B.

On the other hand, in the first pattern, when the paper P having high stiffness is discharged, the supporting holder 64 is subjected to a repulsion force from the paper P, and the torsion spring 82 thus contracts, such that the supporting holder 64 retreats in direction −B. As a result, the paper P is discharged with a low amount of deformation resulting from shaping. Note that, since the paper P having high stiffness is discharged with a low amount of deformation, it is possible to reduce the load on the paper P when the paper P is discharged.

Figure 9:
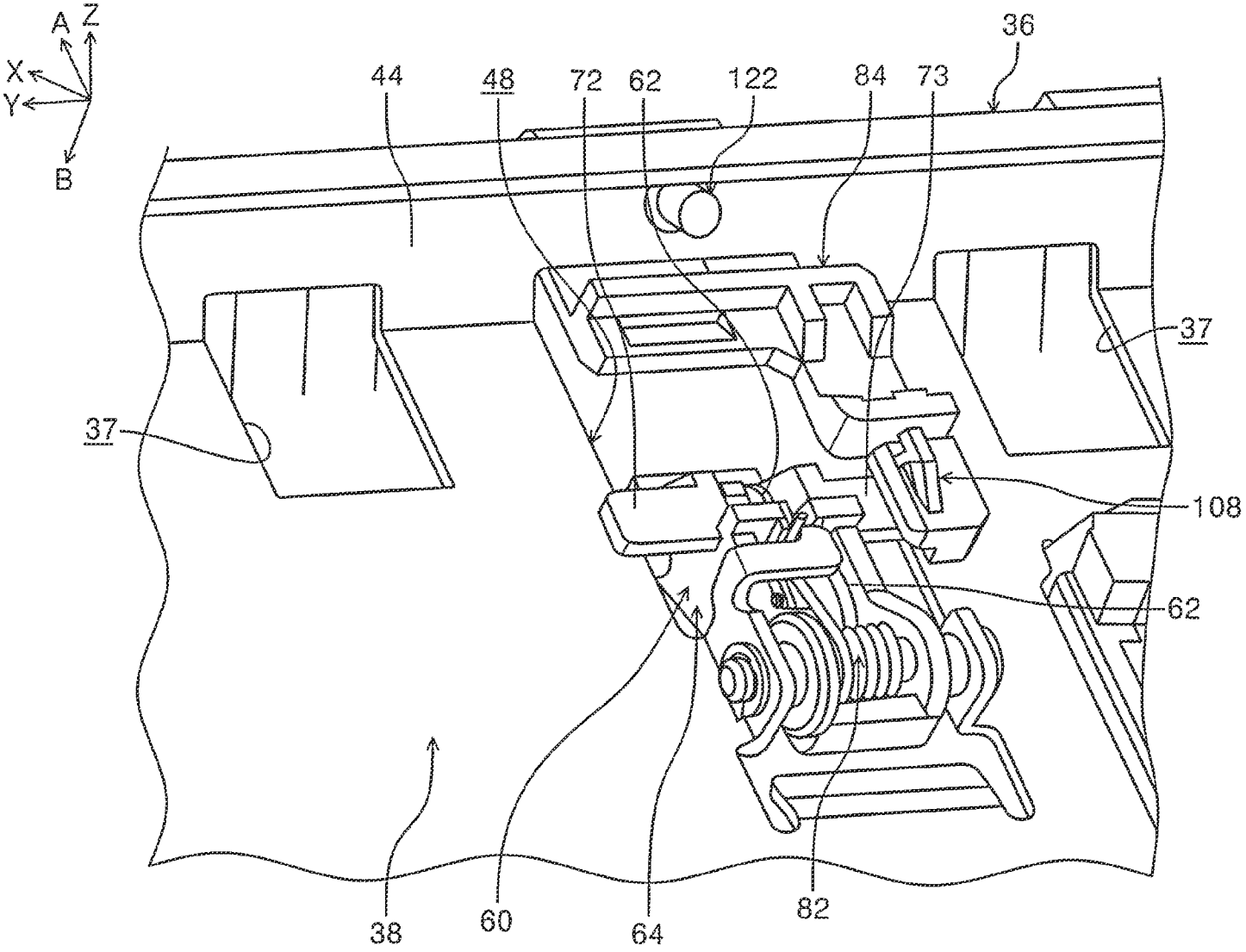
FIG. 9 is a perspective view illustrating a state in which the lever member of the printer according to the embodiment regulates pivoting of the supporting holder.
Figure 10:
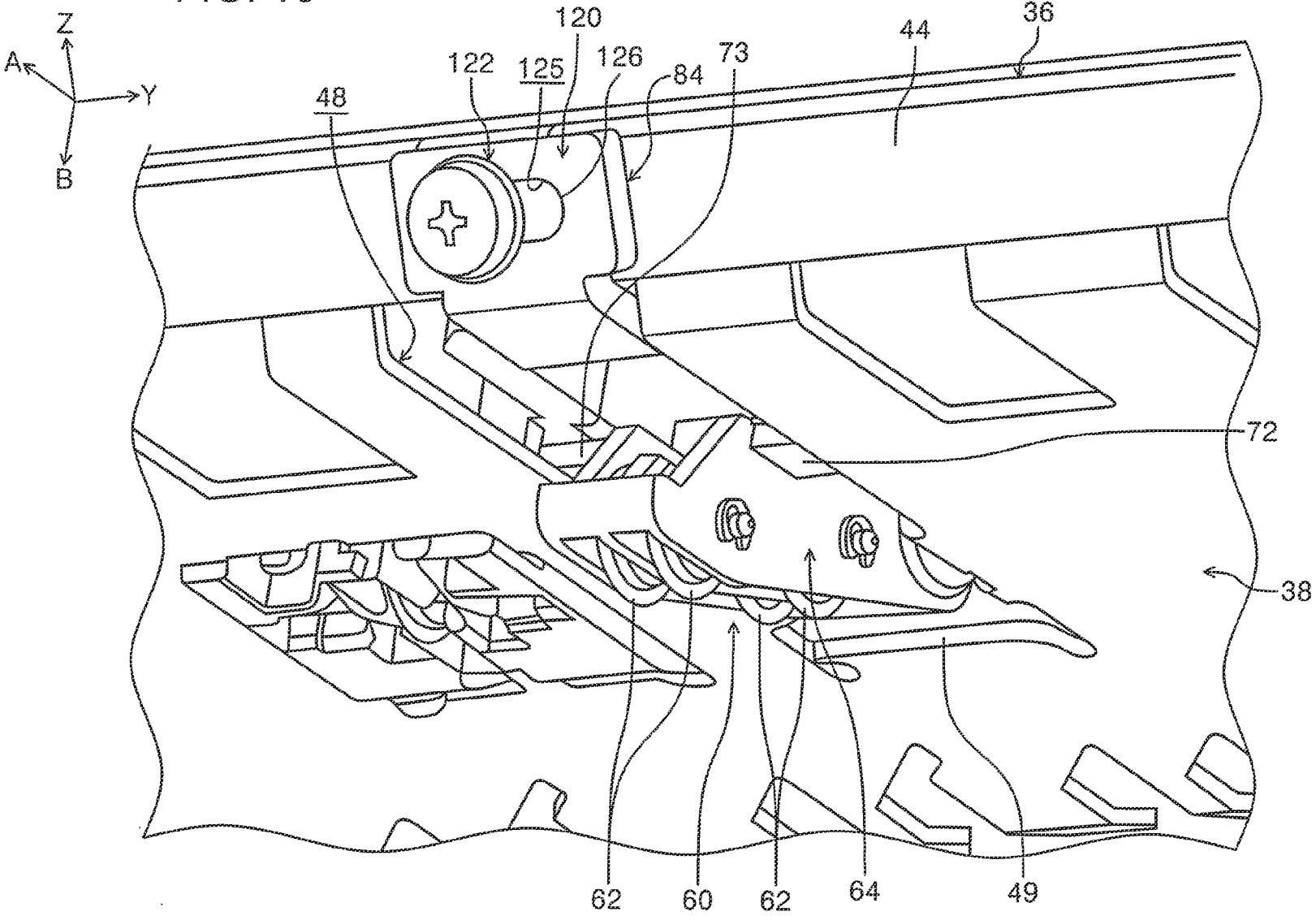
FIG. 10 is a perspective view illustrating a state in which the lever member regulates movement of the supporting holder in a protruding state in the printer according to the embodiment.

As illustrated in FIGS. 9 and 10, in the second pattern, in a state in which the flanges 72 and 73 are in contact with the bottom wall 38, the screw 122 in the fastened state is loosened to move the lever member 84 in the +Y direction. When the −Y direction end of the flange 73 is accommodated in the recess 116 (FIG. 6), pivoting of the deforming section 60 in direction +R and direction −R is regulated. In such a state, the screw 122 is refastened to the side wall 44. The supporting holder 64 and the plurality of toothed rollers 62 are held in a state of protruding to the transport path T (FIG. 2). That is, the deforming section 60 is held at the first position.

Figure 14:
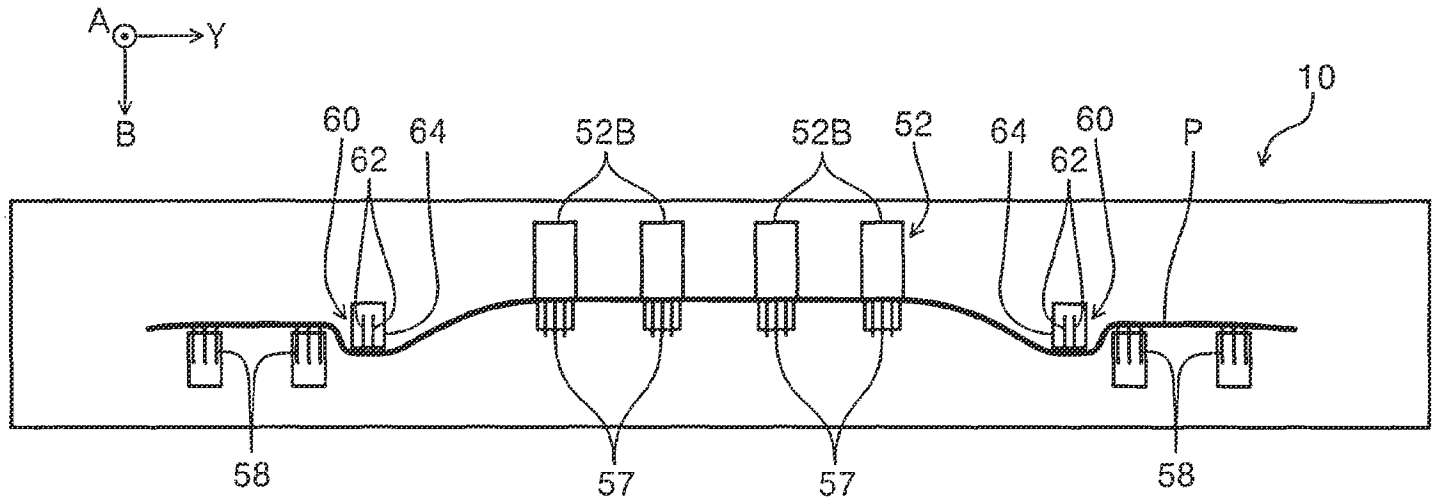
FIG. 14 is a schematic view illustrating a discharge state of paper when a portion of the paper is intentionally shaped by the deforming section in the printer according to the embodiment.

As illustrated in FIG. 14, in the second pattern, when the paper P having high stiffness is discharged, the supporting holder 64 is pressed by the torsion spring 82 (FIG. 9) in direction +B, and the plurality of toothed rollers 62 thus come into contact with the paper P, such that a portion of the paper P in the Y direction is shaped. In an instance in which a plurality of sheets of paper P are stacked on the paper discharge tray 13 (FIG. 1), when the paper P is shaped, for example, the paper P is less likely to deviate in the Y direction, thus making it possible to improve stackability.

Figure 11:
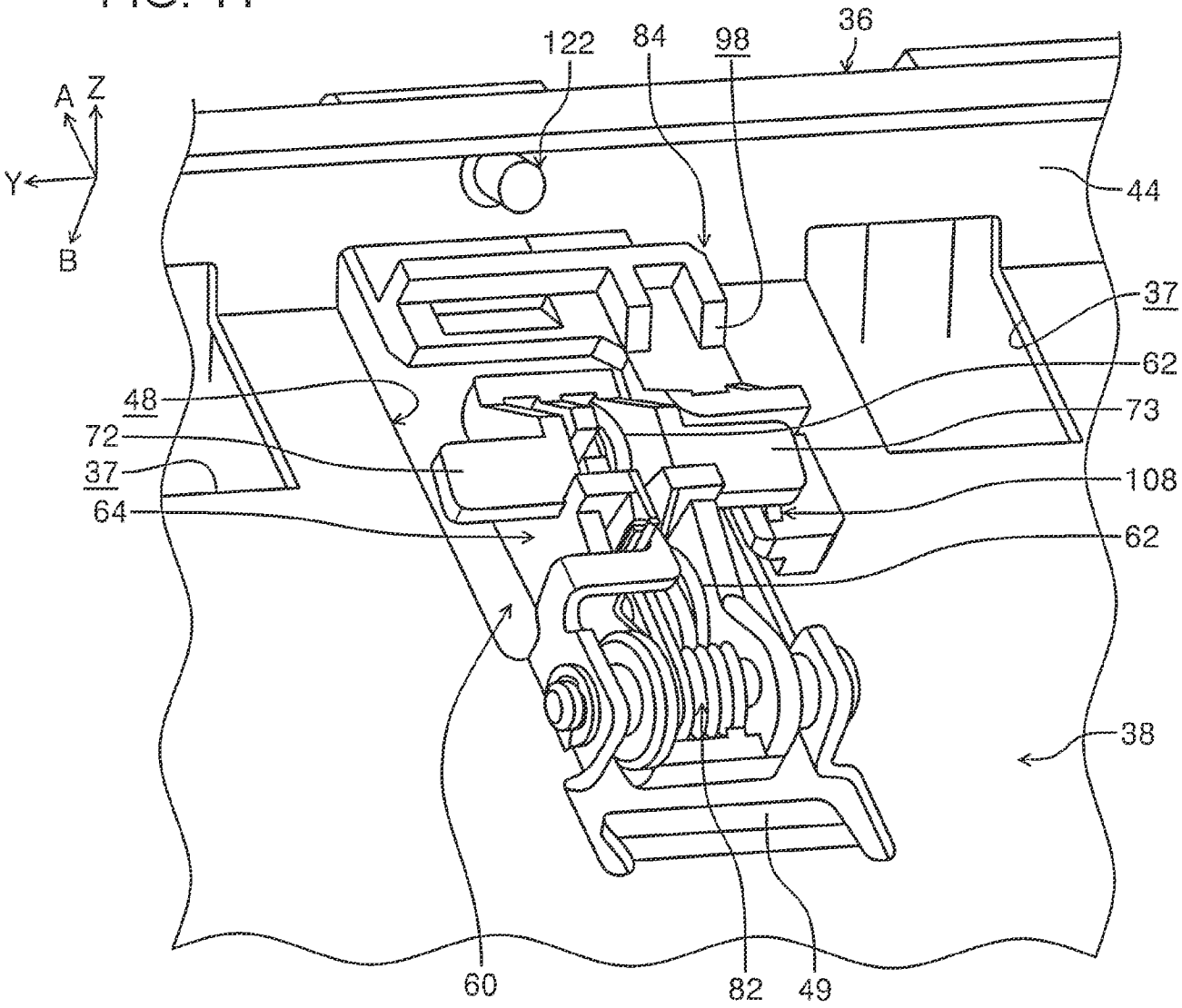
FIG. 11 is a perspective view illustrating a state in which the lever member regulates movement of the supporting holder in a retreat state in the printer according to the embodiment.
Figure 12:
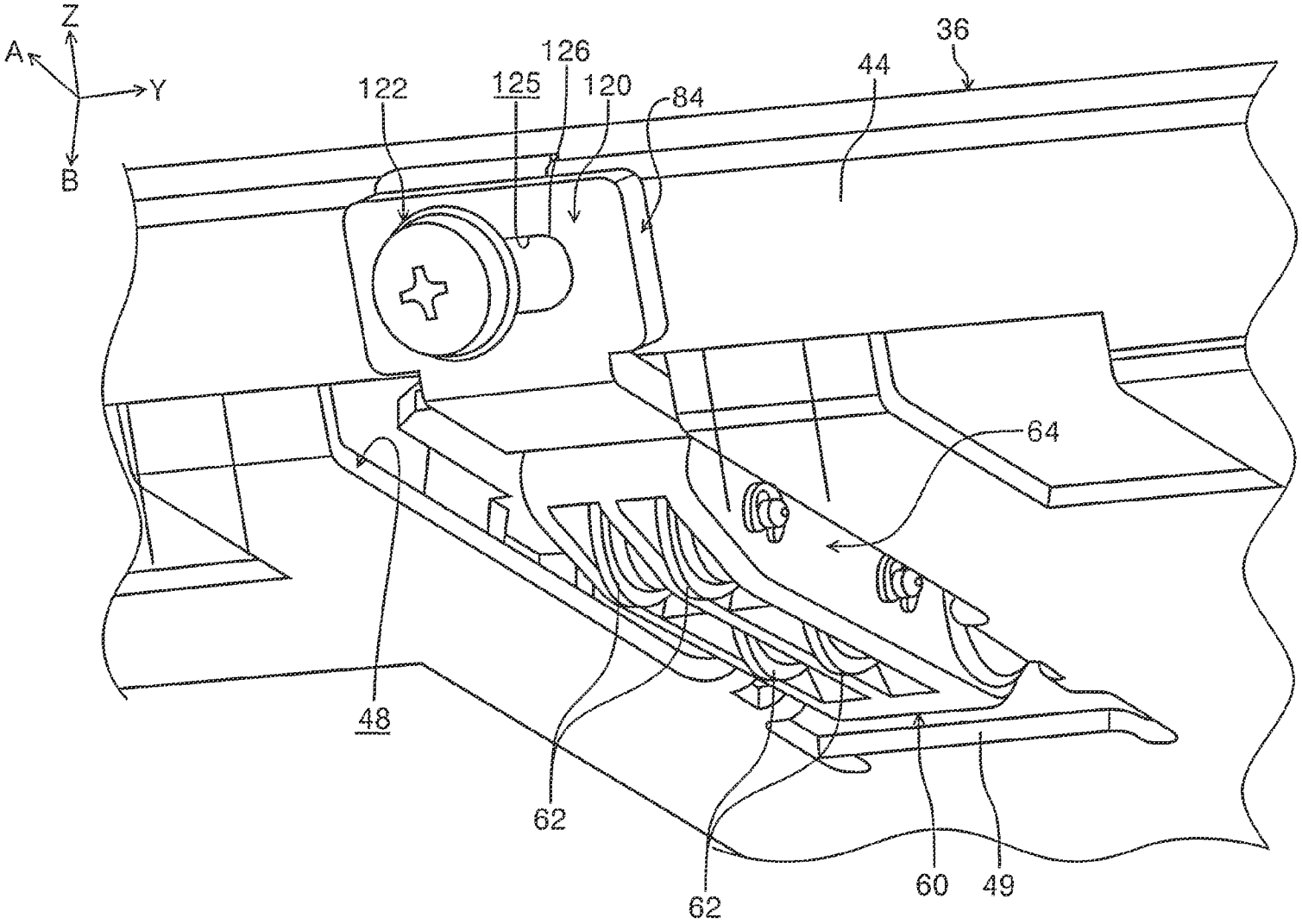
FIG. 12 is a perspective view illustrating a state in which the lever member regulates movement of the supporting holder in the retreat state in the printer according to the embodiment.

As illustrated in FIGS. 11 and 12, in the third pattern, the screw 122 in the fastened state is loosened. Moreover, the supporting holder 64 rotates in direction +R. At this time, the supporting holder 64 continues to rotate in direction +R until the flange 73 is located in direction −B with respect to the protrusion 108. Then, the lever member 84 moves in the +Y direction. When the −Y direction end of the flange 73 is supported by the protrusion 108, rotation of the deforming section 60 in direction −R is regulated. In this state, the screw 122 is refastened to the side wall 44. The supporting holder 64 and the plurality of toothed rollers 62 are held in a state of being retreated from the transport path T. That is, the deforming section 60 is held at the second position.

Figure 15:
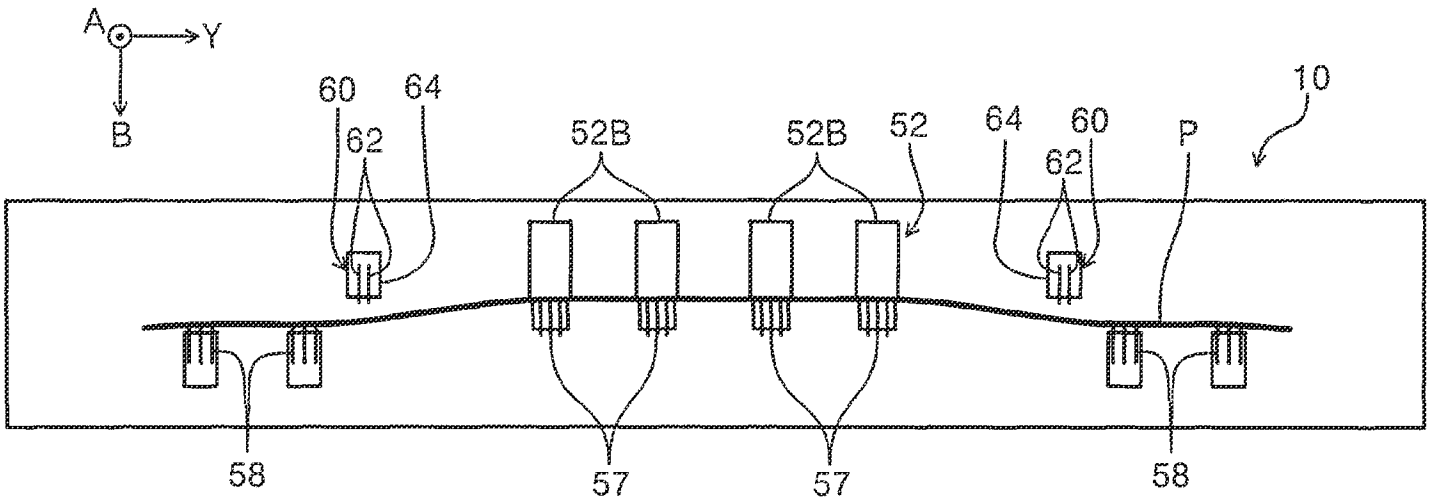
FIG. 15 is a schematic view illustrating a discharge state of paper when a portion of the paper is not shaped by the deforming section in the printer according to the embodiment.

As illustrated in FIG. 15, in the third pattern, when the paper P having low stiffness is discharged, the deforming section 60 does not come into contact with the paper P. That is, the paper P is not shaped by the deforming section 60. As a result, the paper P is discharged in a substantially natural state due to its weight, and the paper P may thus be readily subjected to processing by another processing apparatus.

As described above, according to the printer 10, when the toothed roller 62 of the deforming section 60 comes into contact with the paper P, the toothed roller 62 applies a pressing force to the paper P to shape the paper P.

In the non-regulating state, since the supporting holder 64 of the deforming section 60 is pivotable, the paper P is able to be shaped in accordance with the basis weight of the paper P.

In the regulating state in which the lever member 84 regulates pivoting of the supporting holder 64 at the first position, the toothed roller 62 in contact with the paper P does not retreat from the transport path T, and the paper P is thus able to be shaped with a constant amount of deformation.

In the regulating state in which the lever member 84 regulates pivoting of the supporting holder 64 at the second position, since neither the supporting holder 64 nor the toothed roller 62 is located on the transport path T, it is possible to prevent the paper P from being shaped. Further, when the paper P having high stiffness against a force in direction +B is used, it is possible to prevent the paper P, which is being discharged, from being subjected to a great load.

In this manner, since the pattern for shaping of the paper P by the deforming section 60 is switched between the three patterns in accordance with a type or a state of the paper P, the amount of deformation of the paper P is able to be easily managed.

According to the printer 10, since the lever member 84 switches between the regulating state and the non-regulating state by changing its position relative to the deforming section 60, the lever member 84 whose position has been changed readily retains the regulating state.

According to the printer 10, a size of the printer 10 is able to be reduced in the discharging direction of the paper P compared with a configuration in which the lever member 84 moves in the discharging direction of the paper P.

According to the printer 10, since the guiding section 120 guides the lever member 84 in the Y direction, it is possible to suppress the position of the lever member 84 from being displaced in a direction intersecting the Y direction.

According to the printer 10, since the lever member 84 is able to be guided in the Y direction by inserting the screw 122 into the elongated hole 125 to fasten the screw 122 to the side wall 44, it is possible to simplify a mechanism of the guiding section 120. Further, since the head section 123 of the screw 122 is located downstream in the discharging direction of the paper P, the screw 122 is easily accessed from outside of the printer 10.

According to the printer 10, when the deforming section 60 comes into contact with the inclined section 106, the deforming section 60 changes its position relative to the lever member 84 in direction R. As a result, the deforming section 60 is guided by the inclined section 106 until the deforming section 60 has the regulating state, and the regulating state is thus able to be provided by a simple configuration.

According to the printer 10, by interchanging the flange 73 and the lever member 84 in position in direction R, the regulating state of the deforming section 60 at the first position or the second position is provided, and it is thus possible to simplify a mechanism for providing the regulating state.

According to the printer 10, when the flanges 72 and 73 come into contact with the bottom wall 38 of the guide frame 36, pivoting of the supporting holder 64 of the deforming section 60 is regulated. This makes it possible to suppress the supporting holder 64 from excessively pivoting.

According to the printer 10, when the lever member 84 is moved in a single direction to the flange 73 in contact with the guide frame 36, movement of the flange 73 and pivoting of the supporting holder 64 are regulated, and pivoting of the supporting holder 64 is thus able to be readily regulated compared with a configuration in which the lever member 84 is moved through multiple steps.

According to the printer 10, when at least a portion of the flange 73 is accommodated in the recess 116, the flange 73 moves less freely, thus making it possible to retain the regulating state.

According to the printer 10, since the opening 48 is formed in not only the bottom wall 38 but also the side wall 44, it is possible to suppress the paper P deformed by the deforming section 60 from being caught by the guide frame 36.

According to the printer 10, the lever member 84 that regulates pivoting of the supporting holder 64 on the side opposite to the transport path T side with respect to the guide frame 36 is able to be operated on the transport path T side. Further, when a portion of the opening 48 which is formed in the side wall 44 is at a position away from the transport path T, a portion of the lever member 84 passing through the opening 48 is located at a position away from the transport path T, and it is thus possible to suppress a portion of the paper P shaped by the deforming section 60 from being caught by the portion of the lever member 84.

According to the printer 10, when the paper P comes into contact with the guiding surface 94, the paper P is guided downstream in the discharging direction. In this manner, even when the paper P comes into contact with a portion of the lever member 84, the paper P is guided downstream in the discharging direction, and it is thus possible to suppress the paper P from being caught by the lever member 84.

According to the printer 10, it is possible to manage the amount of deformation of the paper P onto which the ink Q is ejected.

Although the printer 10 according to the embodiment of the disclosure basically has the above-described configuration, it is of course possible, for example, to partially change or omit a configuration without departing from the scope of the disclosure of the present application.

In the printer 10, the lever member 84 may move in direction A or direction B. The lever member 84 does not necessarily move with the axial direction extending along the shaft K passing through the pivot center C of the supporting holder 64 as the intersecting direction. The guiding section 120 is not limited to being configured to guide the lever member 84 in the Y direction and may be configured to guide the lever member 84 in a direction different from the Y direction. The guiding section 120 is not limited to being constituted by the screw 122 and the edge portion 126 of the elongated hole 125 and may be a guide rail provided in the guide frame 36. The inclined section 106 is not limited to being formed in the lever member 84 and may be formed in the flange 73. Alternatively, the inclined section 106 may be formed in both of the lever member 84 and the flange 73.

In the printer 10, the supporting holder 64 does not necessarily include the flange 72 or 73, and another portion of the supporting holder 64 may be regulated by the lever member 84. The flanges 72 and 73 may be directly subjected to a pressing force from the pressing section. The lever member 84 is not limited to being moved in only a single direction to the flange 73 and may be moved while switching its moving direction through multiple steps. The lever member 84 does not necessarily include the recess 116 and may regulate movement of the flange 73 in only direction R. The lever member 84 is not limited to being moved manually by an operator and may be moved automatically by using a motor or a solenoid.

In the printer 10, the opening 48 does not necessarily include the second opening section 48B. The lever member 84 may be accommodated on the side opposite to the transport path T side to be operated through the opening 48. The lever member 84 does not necessarily include the guiding surface 94.

By omitting the line head 28, the printer 10 may be configured as a discharging apparatus that merely discharges the paper P.

A plurality of deforming sections 60 may be coupled in the Y direction such that the deforming sections 60 pivot at substantially the same time. Moreover, pivoting may be selectively performed such that some of the plurality of deforming sections 60 pivot at the same time and the other deforming sections 60 pivot individually.

The contact section is not limited to the plurality of toothed rollers 62 and may be a rib that protrudes in direction +B from the supporting holder 64. Moreover, the contact section may be a belt member that is rotated by a pulley. The plurality of toothed rollers 62 may be driven by a motor.

The pressing section is not limited to the torsion spring 82 and may be configured to use elastic deformation of the supporting holder 64. That is, the supporting holder 64 may function as both of the holding section and the pressing section. The pressing section is not limited to being configured to use an elastic force and may be configured to perform pressing by using a repulsion force generated by magnets of the same polarity.

The regulating section may be constituted by members provided separately, that is, a first regulating section for regulating pivoting in direction +R and a second regulating section for regulating pivoting in direction −R or may be constituted by a single member for regulating pivoting in direction +R and pivoting in direction −R. Moreover, the deforming section is not necessarily regulated in a contact manner and may be regulated in a non-contact manner by using a magnetic force. The regulating section may be provided in the deforming section so as to be movable.

The guiding section may be provided in the regulating section or the apparatus main body.

The flange on one end side in the Y direction may be used to regulate first pivoting (rotation in direction +R) of the deforming section, and the flange on the other end side may be used to regulate second pivoting (rotation in direction −R) of the deforming section. Further, the regulating section may be provided on each side of the deforming section in the axial direction.

What is claimed is:

1. A discharging apparatus comprising:

an apparatus main body in which a transport path for transporting a sheet is provided;

a deforming section that includes a contact section that is configured to come into contact with the sheet, a holding section that includes a free end for holding the contact section and a base end held by the apparatus main body and that is configured to pivot between a first position at which the contact section is located on the transport path and a second position at which the contact section is not located on the transport path, and a pressing section that presses the holding section from the second position to the first position and a regulator that is configured to switch between a regulating state in which pivoting of the holding section at the first position, or the second position is regulated and a non-regulating state in which pivoting of the holding section is not regulated, wherein when the holding section is positioned at the first position and the regulator is in the regulating state the deforming section is configured to deform the sheet discharged from the transport path by the contact section coming into contact with the sheet, and wherein when the holding section is positioned at the first position and the regulator is in the non-regulating state, the deforming section is configured to deform the sheet discharged from the transport path by the contact section coming into contact with the sheet.

2. The discharging apparatus according to claim 1, wherein the regulator is provided to be configured to change a position relative to the deforming section in an intersecting direction that intersects a pivoting direction of the holding section.

3. The discharging apparatus according to claim 2, wherein the regulator moves with an axial direction extending along a shaft passing through a pivot center of the holding section as the intersecting direction.

4. The discharging apparatus according to claim 3, further comprising a guiding section including a screw that guides the regulator in the axial direction.

5. The discharging apparatus according to claim 4, wherein the guiding section includes the screw including a head section and a shaft section and an edge portion of an elongated hole which extends in the axial direction and into which the shaft section is inserted, and the head section is located downstream in a discharging direction of the sheet with respect to the shaft section.

6. The discharging apparatus according to claim 2, further comprising an inclined section that extends in a direction intersecting the intersecting direction, wherein the inclined section changes a position of the deforming section relative to the regulator in the pivoting direction by moving the regulator and the deforming section relative to each other in the intersecting direction.

7. The discharging apparatus according to claim 2, wherein the holding section includes a flange, the regulator regulates pivoting of the holding section by regulating movement of the flange, and an order in which the flange and the regulator are disposed in the pivoting direction is reversed between when the holding section is at the first position and when the holding section is at the second position.

8. The discharging apparatus according to claim 7, wherein the flange comes into contact with the apparatus main body by being subjected to a pressing force from the pressing section when the regulator has the non-regulating state.

9. The discharging apparatus according to claim 8, wherein the regulator is moved to the flange in contact with the apparatus main body to thereby regulate movement of the flange.

10. The discharging apparatus according to claim 7, wherein the regulator includes a recess that is configured to accommodate at least a portion of the flange.

11. The discharging apparatus according to claim 1, wherein the apparatus main body includes a path member that has a bottom wall which forms a portion of the transport path and a side wall which is provided to stand upright downstream in a discharging direction of the sheet in the bottom wall, and the path member includes an opening which is formed across the bottom wall and the side wall and which enables the deforming section to pass therethrough.

12. The discharging apparatus according to claim 11, wherein the regulator is provided so as to extend from a side of the transport path with respect to the path member toward a side opposite to the side of the transport path through the opening of the side wall.

13. The discharging apparatus according to claim 12, wherein the regulator includes a guiding surface for guiding the sheet downstream in the discharging direction.

14. The discharging apparatus according to claim 1, wherein the apparatus main body includes an ejecting section for ejecting a liquid onto the sheet.

15. A discharging apparatus comprising:

an apparatus main body in which a transport path for transporting a sheet is provided;

a deforming section that includes a contact section that comes into contact with the sheet discharged from the transport path, a holding section that includes a free end for holding the contact section and a base end held by the apparatus main body and that is configured to pivot between a first position at which the contact section is located on the transport path and a second position at which the contact section is not located on the transport path, and a pressing section that presses the holding section from the second position to the first position, the deforming section enabling the contact section to come into contact with the sheet to deform the sheet; and a regulator that is configured to switch between a regulating state in which pivoting of the holding section at the first position, or the second position is regulated and a non-regulating state in which pivoting of the holding section is not regulated, wherein the regulator is provided to be configured to change a position relative to the deforming section in an intersecting direction that intersects a pivoting direction of the holding section, and wherein the regulator moves with an axial direction extending along a shaft passing through a pivot center of the holding section as the intersecting direction.

* * * * *